US005736001A

United States Patent [19]

Samuelson

[11] Patent Number: 5,736,001

[45] Date of Patent: Apr. 7, 1998

[54] COMBINATION DRYWALL JOINT COMPOUND HOPPER AND DRYWALL TAPE DISPENSER

[76] Inventor: Jeffrey C. Samuelson, Box 2575, Ashville, N.Y. 14710

[21] Appl. No.: 629,883

[22] Filed: Apr. 10, 1996

[51] Int. Cl.[6] ..... B32B 31/00

[52] U.S. Cl. ..... 156/575; 156/577; 156/578; 118/405

[58] Field of Search ..... 156/574, 575, 156/577, 578, 579; 118/123, 405, 414, 415, 419, 424

[56] References Cited

U.S. PATENT DOCUMENTS

| | | | |
|---|---|---|---|
| 3,112,225 | 11/1963 | Harms | 118/405 X |
| 3,342,160 | 9/1967 | Weeks | 118/415 X |
| 3,496,909 | 2/1970 | Bennett, Jr. | 118/415 X |
| 4,406,730 | 9/1983 | Altmiy | 156/574 |
| 4,440,410 | 4/1984 | Bradshaw | 280/47.26 |
| 4,757,783 | 7/1988 | Matheny | 118/413 |
| 4,996,941 | 3/1991 | Mills | 156/575 X |
| 5,114,527 | 5/1992 | Stern et al. | 156/575 |

*Primary Examiner*—James Engel
*Attorney, Agent, or Firm*—David L. Volk; John D. Gugliotta

[57] ABSTRACT

A combination drywall joint compound hopper and drywall tape dispenser is disclosed having an open topped basin affixed atop said a flat stabilized base. The basin is for storing drywall joint compound, and a tape holder is mounted adjacent to and aligned with the basin. A first pinch roller extending laterally across the top of the basin, and a second pinch roller extends laterally across and within the basin aligned in a parallel manner with said first pinch roller across and near the open top of the basin such as to form a separation gap between the outermost edges of the pinch rollers of approximately ⅛ inch, for allowing for passage of a section of drywall tape between said two pinch rollers while as the same time acting as a scraper to govern the amount of joint compound which adheres to the surface of the drywall tape. When a roll of drywall tape discharged tape from said roll, it is passed through an entry port along the front side of the basin, directed downward, to and around said turn rod and then redirected upward, passing between the pinch rollers, such that when said basin is filled with drywall joint compound then the drywall tape will be dispensed with a coating of said drywall joint compound.

4 Claims, 3 Drawing Sheets

COMBINATION DRYWALL JOINT COMPOUND HOPPER AND DRYWALL TAPE DISPENSER

BACKGROUND OF THE INVENTION

1. Field of the Invention

The present invention relates generally to tape dispensers and, more particularly, to a dispenser for drywall tape in combination with a drywall joint compound hopper.

2. Description of the Related Art

It is a commonly used construction method to utilize drywall products in the finishing of interior walls. In order for drywall to be painted, papered, or textured, it must be finished in order to make the individual pieces look like one smooth section of wall or ceiling. Critical areas when finishing drywall include filling the damage caused by supporting fasteners, filling the tapered seam edges, and finishing the un-tapered butt joint edges between sections of drywall. A drywall joint compound colloquially referred to as "mud" is used to fill holes and seams, and because of shrinkage involved with such compounds, numerous coats are required. In finishing joints and seams, a strip of drywall tape is applied between layers of joint compound in a manner that the tape lies beneath the surface of the drywall.

Many tools and methods are known in the related art for use with such drywall products. Specifically, both tape dispensers and drywall compound application hoppers are known for use with such drywall products. For example, in U.S. Pat. No. 5,114,527, issued in the name of Stern et al., a drywall tape applying tool is disclosed wherein the tape moves through a chamber containing a taping compound.

Also, in U.S. Pat. No. 4,757,783, issued in the name of Matheny, a container-to-tape dispenser for drywall joint compound is disclosed. And also, in U.S. Pat. No. 4,406,730, issued in the name of Altmix, a drywall tape dispenser is disclosed. And finally, in U.S. Pat. No. 4,440,410, issued in the name of Bradshaw, a hopper for containing drywall joint compound is disclosed for containing drywall joint compound.

Although these numerous examples exist for providing tape dispensing, for storing drywall joint compound, and even for application of drywall joint compound onto drywall tape, nowhere exists a device for pulling drywall tape through a series of rods in order to prepare the tape with the proper amount of drywall joint compound. Consequently, a need has been felt for providing such an apparatus and method in an affordable, easy to clean manner.

SUMMARY OF THE INVENTION

It is therefore an object of the present invention to provide an improved drywall joint compound hopper in combination with a drywall tape dispenser.

It is a feature of the present invention to provide an improved drywall joint compound hopper in combination with a drywall tape dispenser which properly prepares drywall tape and applies and dispenses joint compound.

Briefly described according to the preferred embodiment of the present invention, a combination tape and compound applying device is disclosed used to both dispense and coat tape needed to cover seams and holes when hanging drywall. By pulling the end of the tape over the paper tape roll and through a joint compound hopper, a required length of tape is coated and dispensed. The tape, which has been coated with compound by the dispenser, may be placed over cuts and gaps in the drywall.

An advantage of the present invention is that it is light-weight and therefore easily transportable throughout a user's jobsite.

Another advantage of the present invention is that it saves time by combining taping and compound spreading.

Further, a preferred embodiment of the present invention is easy to operate, easy to clean, and easily refillable.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
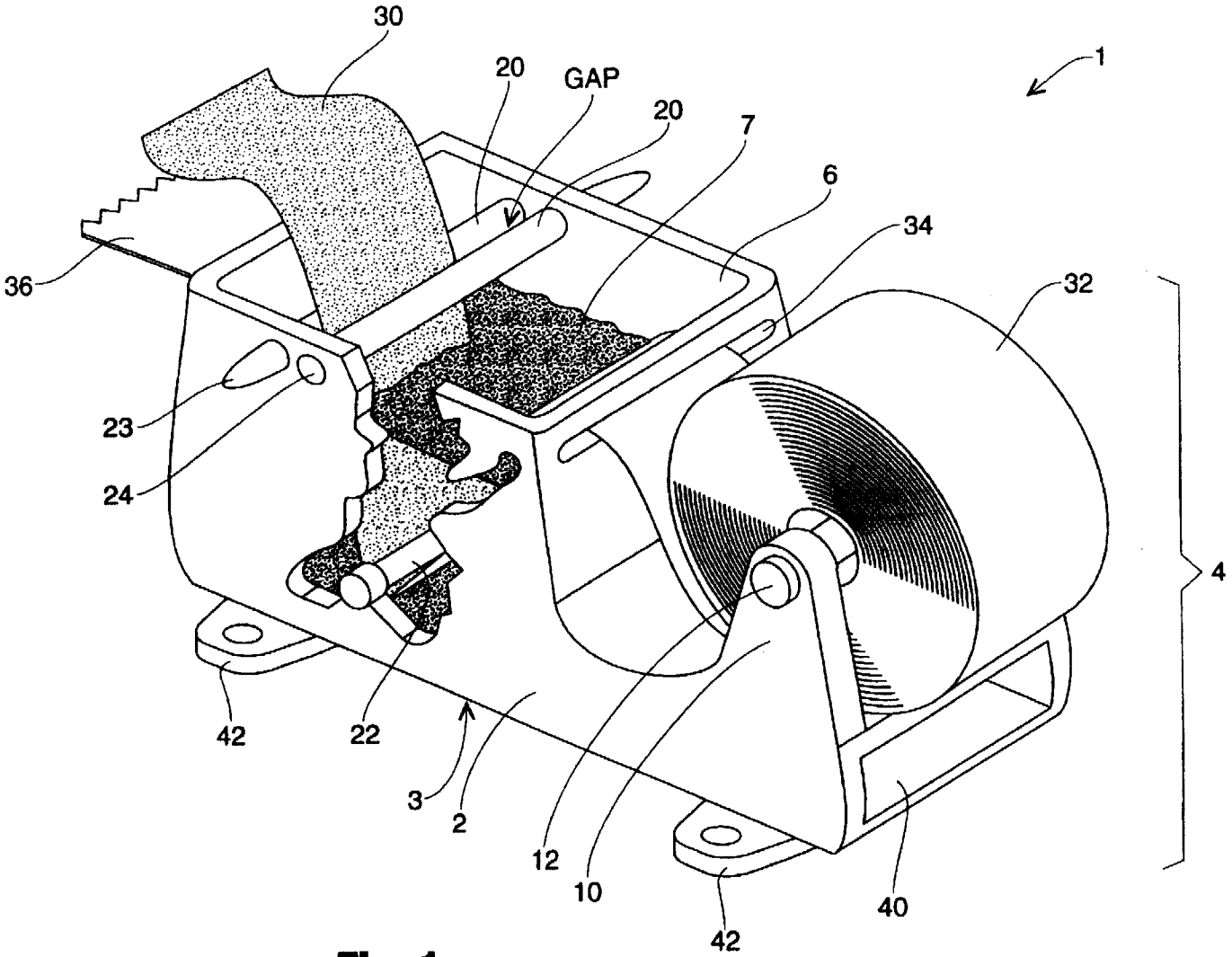
FIG. 1 is a perspective view of combination drywall joint compound hopper and drywall tape dispenser according to the preferred embodiment of the present invention.

Referring now to FIG. 1, a combination drywall joint compound hopper and drywall tape dispenser (dispenser) 1 is shown, according to the present invention, having an expanded, stabilized base 2 having a flat lower surface 3. Integrated within and supported by the base 2 are a tape holder 4 adjacent to and aligned with an open topped basin 6. Although a variety of specific sizes are envisioned as being capable of practicing the preferred embodiment, it is felt that particular advantages are achieved if the base 2 has an overall width of approximately 10 inches and the basin 2 has the capacity for holding approximately 2 gallons of joint compound 7. In its preferred embodiment it is also felt that the interior of the basin 6 has rounded corners and slanted sidewalls in order to better direct the flow of joint compound towards the lowest point near the turn rod 22. The tape holder 4 is formed from a pair of upwardly extending mounting ears 10 fixed to the base 2 parallel to one another and connected by a removable, cylindrical axle 12. With the ears 10 extending above the base 2 such as to create a clearance between the axle 12 and the base 2 of at least 6 inches, in combination with other specific configurations as described, numerous advantages result. Such a width allows for the tape holder 4 to accommodate three standard 2 inch rolls of drywall tape aligned in an adjacent manner upon the axle 12. Such a height allows for the tape holder 4 to accommodate a standard roll of drywall tape of 1,000 linear feet, which has a diameter of 10 inches. The basin 6 with an open top having a significant capacity also allows a user to access the contents in order to mix any joint compound 7 that may have an inappropriate consistency, as well as providing a capacity capable of supply the requirements for a significant usage of drywall materials.

Figure 2:
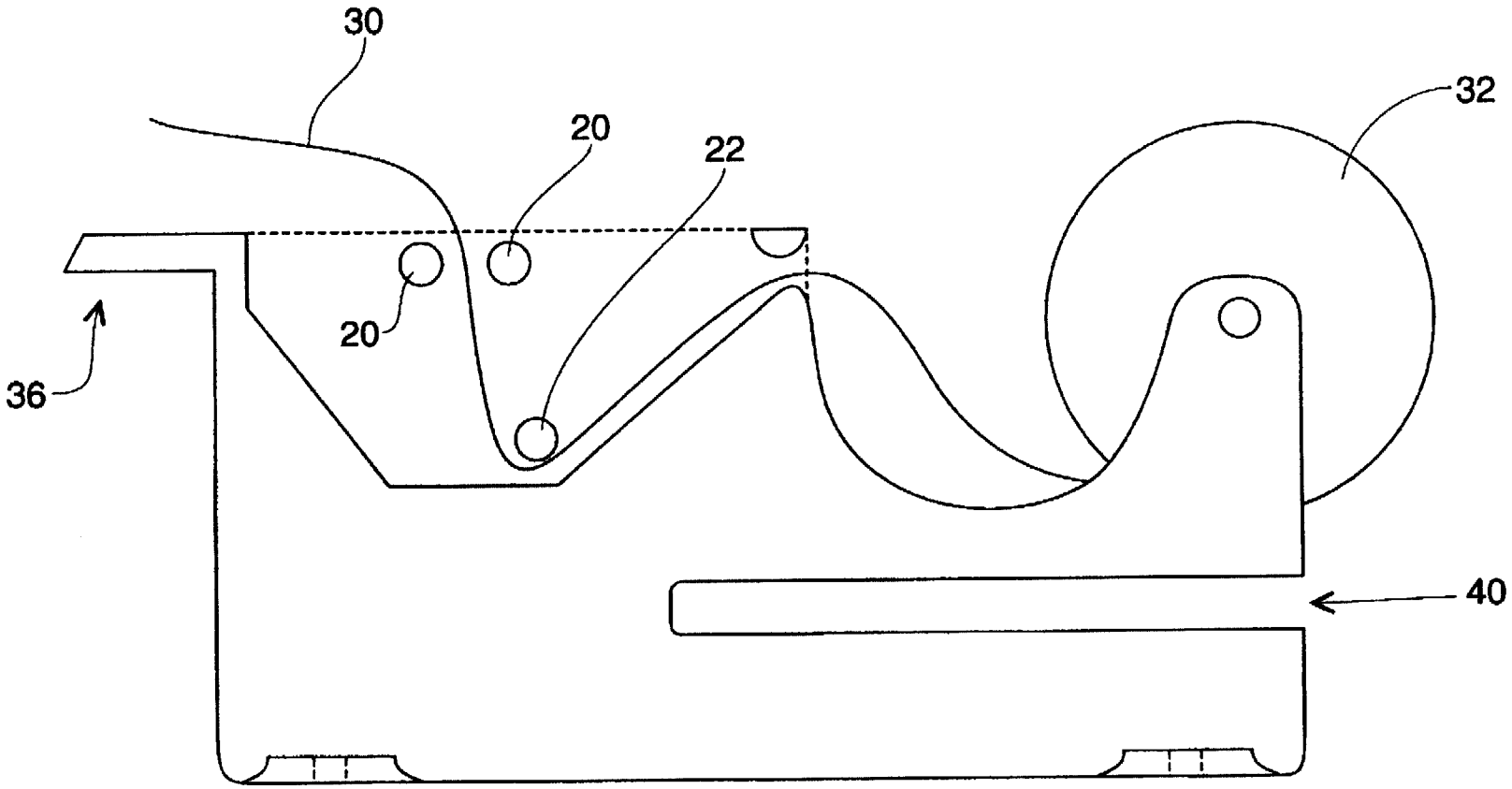
FIG. 2 is a cross sectional side elevational view thereof.

Referring to FIG. 2, a pair of pinch rollers 20 and the turn rod 22 are shown extending across and within the basin 6. Each pinch roller 20 is an elongated, generally cylindrical rod having a smooth outer surface. One end of each pinch roller 20 is threaded, and is received within and held by a threaded receiving recess 24 formed along the outer wall of the basin 2. Opposite the threaded end of each pinch roller 20 is a flattened wing 23 formed by extending and flattening the end of the pinch roller 20 within the confines of the overall outer circumference. In this configuration, each pinch roller 20 can be manually engaged with the receiving recess 24 prior to operation, and removed in a wing-nut like fashion afterwards. Such removability aids in cleaning the dispenser 1, and especially the basin 6 which contains the joint compound 7. The pinch rollers 20 are aligned in a parallel manner across and near the open top of the basin 6. A separation gap between the outermost edges of the pinch rollers 20 of approximately ⅛ inch allows for passage of a section of drywall tape between the two rollers 20, while at the same time acting as a scraper to govern the amount of joint compound 7 which adheres to the surface of the drywall tape. Additionally, the turn rod 22 is positioned across the basin 6 and parallel to the pinch rollers 20 (and the axle 12) at an elevation near the bottom of the basin 2. It is envisioned that as tape 30 exits the tape roll 32, it passes through an entry port 34 along the front side of the basin wall. The tape 30 then is directed downward, to and around the turn rod 22, and then redirected upward, passing between the pinch rollers 20. It is envisioned that the joint compound 7 will fill the basin 2 at a level above this turn rod 22.

Figure 3:
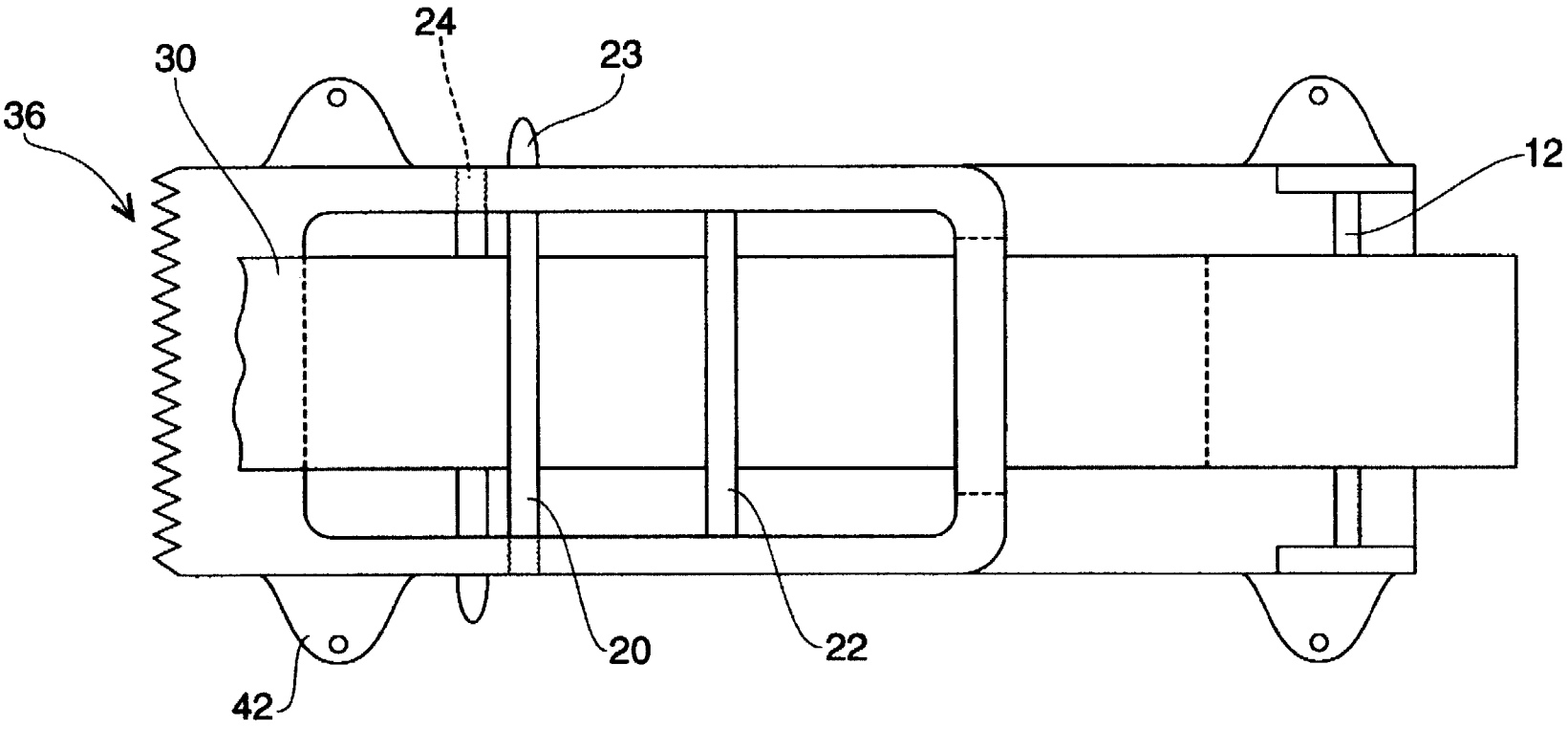
FIG. 3 is a top plan view thereof.

FIG. 3 also shows this path traveled by the drywall tape 30. Upon exiting from between the pinch rollers 20, the tape 30 can be pulled across a cutting platform 36 which forms the rear edge along the back wall of the basin 2, parallel and opposite to the entry port.

Many additional features are envisioned as being added to the basic embodiment as herein described. For example, due to the size of the base 2, a storage tray 40 can be incorporated therein as a slot and provide a location for conveniently storing drywall tools such as spatulas. And, a mounting means 42 for securing the base 2 to a flat, horizontal work surface can also be included.

2. Operation of the Preferred Embodiment

To use the present invention, the dispenser 1 must be placed on a secure, flat, horizontal surface, preferably in a convenient and centrally located working area. A roll of drywall tape is then mounted rotatably upon the axle 12 and the pinch rollers 20 and turn rod 22 are threadingly engaged into their respective positions across the basin 6. Drywall tape is then reeled from the roll and threaded through the entry port 34, and directed downward around the turn rod 22. The tape is then directed upward and threaded between the gap separating the pinch rollers 20. At this point, joint compound 7 can be added in a sufficient quantity to the basin 6. As the tape 30 passes down into the joint compound it is thoroughly soaked, or "creamed", in a manner that is the most efficient for performing such drywall work. The coated tape can now be smoothly and evenly "dispensed", with required lengths removed by merely tearing against the cutting platform 36 in a manner similar to the use of a conventional tape dispenser. Pulling the tape through the basin will cause tape to be dispensed with an even, consistent coating of joint compound in a manner that can allow an individual to easily become adept.

The foregoing description is included to illustrate the operation of the preferred embodiment and is not meant to limit the scope of the invention. The scope of the invention is to be limited only by the following claims.

What is claimed is:

1. A drywall tape and compound dispenser comprising:

a. a basin for storing drywall joint compound;

b. a tape holder adjacent to the basin;

c. an elongated, generally cylindrical first member extending across the basin and positioned near the top of the basin;

d. an elongated, generally cylindrical second member extending across the basin and parallel to the first member;

e. the first and second members each having a threaded portion at one end which is threadedly attachable to one side of the basin;

f. the first and second members each being flattened at an end opposite of the threaded portion to provide a handle for use when threadedly engaging and disengaging the member from the basin, the handle being in the form of a single tapered wing extended generally along a longitudinal axis of the member;

g. the first and second members forming a gap therebetween for permitting passage of drywall tape between the first and second members and for acting as a scraper to govern the amount of joint compound which adheres to the drywall tape; and h. an elongated, generally cylindrical turn rod extending across the basin parallel to the first and second members near a bottom of the basin;

i. wherein the dispenser is adapted to support a roll of drywall tape on the tape holder, the drywall tape extending from the roll, toward and around the turn rod, then toward and between the first and second members;

j. whereby when the basin is filled with drywall joint compound, the drywall tape is deliverable from the dispenser with a coating of the drywall joint compound on the drywall tape.

2. The dispenser of claim 1, further comprising a cutting platform for separating a section of the drywall tape from the roll, the cutting platform positioned such that the drywall tape can be pulled across the cutting platform after the drywall tape exits from between the first and second members.

3. The dispenser of claim 1, further comprising a slotted cavity within the base for storage of tools therein.

4. The dispenser of claim 1 further comprising a mounting means for securing the dispenser to a flat, horizontal surface.

* * * * *